US005515584A

United States Patent [19]

Adell

[11] Patent Number: 5,515,584

[45] Date of Patent: May 14, 1996

[54] WIRE CONNECTION SYSTEM AND METHOD OF ASSEMBLY

[76] Inventor: Carrie Adell, Box 6924, Santa Fe, N.M. 87502

[21] Appl. No.: 370,635

[22] Filed: Jan. 10, 1995

[51] Int. Cl.[6] ..... A44B 9/12; B21F 43/00

[52] U.S. Cl. ..... 24/709.8; 24/707.6; 63/13; 63/20; 29/896.41; 29/896.42

[58] Field of Search ..... 29/160.6; 63/12, 63/13, 20; 24/706.4, 707.6, 709.8

[56] References Cited

U.S. PATENT DOCUMENTS

| | | | |
|---|---|---|---|
| 148,390 | 3/1874 | Tappan . | |
| 483,214 | 9/1892 | Gaynor | 63/13 |
| 635,249 | 10/1899 | Hay . | |
| 741,024 | 10/1903 | Frantzius . | |
| 822,335 | 6/1906 | Almy | 24/706.4 |
| 1,515,313 | 11/1924 | Pejchar . | |
| 2,223,552 | 12/1940 | Christman | 24/707.6 |
| 2,275,984 | 3/1942 | Nitchman . | |
| 2,287,865 | 6/1942 | Carleton . | |
| 4,041,946 | 8/1977 | Barton . | |

*Primary Examiner*—P. W. Echols
*Attorney, Agent, or Firm*—Barnard, Brown & Michaels

[57] ABSTRACT

The present invention reaches a wire connection system that includes a wire and two tubes. The wire has one end that is threaded and fits into one of the tubes that is also threaded. The tubes are connected and oriented between 45° and 135° with respect to one another. The second end of the wire can be removably secured in the second tube thereby preventing rotation of the first tube. In the preferred embodiment, the tubes are perpendicular to one another.

6 Claims, 1 Drawing Sheet

WIRE CONNECTION SYSTEM AND METHOD OF ASSEMBLY

FIELD OF THE INVENTION

The invention pertains to the "findings" in the field of jewelry. ("Findings" are the mechanical parts of jewelry which are assembled to make larger parts). More particularly, the invention pertains to a wire connector system that removably fastens to one end of a wire and holds the other end of the pin wire when the jewelry is fastened in place.

BACKGROUND OF THE INVENTION

Beads are being sold nearly everywhere, and being made by hobbyist and professional craftspeople. Professional craftspeople and hobbyists alike are producing their own beads in metals, enamels, gemstones, glass, clay and polymer clays, even in plastics and paper. Fanciers collect beads for their historical and anthropological, as well as intrinsic and esthetic value.

To a jeweler with the proper tools and experience, making fastening systems for mounting of these beads and other ornaments is easy. However, the average bead fancier who wants to make his or her beads as earrings, brooches, or pendants may not have the skill, equipment or time to make these findings upon which to mount pierced ornaments. Therefore, standard findings and other component which are available do not meet the needs of the consumer. The brooch, earring and pendant components (findings) currently available do not offer creative latitude and the look of finished fine jewelry. Furthermore, those findings with threaded components do not have locking features.

U.S. Pat. Nos. 148,390; 635,249; 1,515,313; 2,275,984; 2,287,865; and 4,041,946 show pins or earrings with a wire that has a fastening system on one end that holds the other end of the wire while fastened. The fastening systems are not removable from the wire. This is a critical limitation, because beads or stone can not be applied from either side.

U.S. Pat. No. 741,024 discloses a hat fastener made from a wire and a bead with two parallel holes for securing the wire. One end of the wire and one hole in the bead are threaded. The threaded end of the wire is screwed into the threaded hole and the wire is bent back on itself 180°. The non-threaded end of the wire is removably held in the other hole in the bead. While this device might work well for hat pins, the fact that the holes are parallel limits the usefulness of the device for making pins and earrings. In most instances the pin or earring forms a loop wherein the two ends of the wire are not parallel when they come back together.

SUMMARY OF THE INVENTION

The present invention teaches a wire connection system that includes a wire and two tubes. The wire has one end that is threaded and fits into one of the tubes that is also threaded. The tubes are connected and oriented between 45° and 135° with respect to one another. The second end of the wire can be removably secured in the second tube by friction and the springiness of the wire. In the preferred embodiment, the tubes are perpendicular to one another.

The wire connection systems can be used to create jewelry. Any jewelry items desired on the wire near the threaded end of the wire are placed on the wire from the threaded end. The threaded end of the wire is then secured into the threaded tube. Any jewelry items desired on the wire near the second end are placed on the wire from the second end. The second end of the wire is secured by positioning the second end of the wire within the second tube. This way the jewelry can be fastened and unfastened by the wearer. Furthermore, the wearer can conveniently add or remove items on either side of the wire by removing the tube connector from the wire. For applications as a brooch or pendant the second end of the wire would usually be used to secure the jewelry to the fabric rather than to hold ornamental items.

DESCRIPTION OF THE PREFERRED EMBODIMENT

Figure 1A:
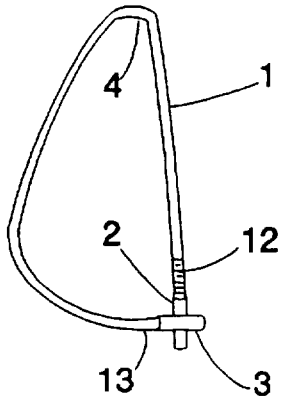
FIGS. 1*a* and 1*b* show a wire connection system in a shape for making an earring fastened and disassembled.
Figure 1B:
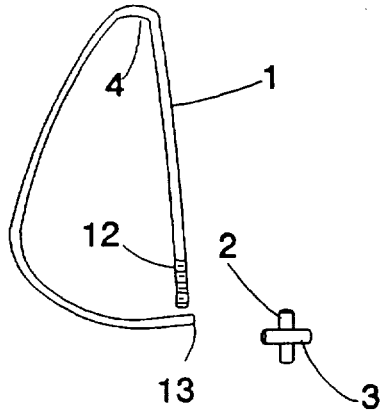

FIGS. 1*a* and 1*b* show a wire connection system of the present invention. The wire connection system includes a wire 1, a first tube 2 and a second tube 3. The first tube 2 is threaded. The wire 1 has one end 12 that is threaded and fits into the tube 2 that is also threaded. The tubes 2 and 3 are connected and oriented between 45° and 135° with respect to one another. The second end 13 of the wire lean be removably secured in the second tube 3. In the preferred embodiment, the tubes 2 and 3 are perpendicular to one another as shown in FIGS. 1*a* and 1*b*.

The wire connection system can be used to create jewelry. Any ornament items, i.e. beads, drilled stones, shell, clay, etc., desired on the wire 1 near the threaded end 12 of the wire 1 are placed on the wire 1 from the threaded end 12. The threaded end 12 of the wire 1 is then secured into the threaded tube 2.

The end 13 of the wire 1 is then passed through a pierced earlobe (if worn as an earring) or through the garment (if worn as a brooch) and secured into the second tube 3, where it locks the connector in place and prevents rotation and unthreading of the wire 1 from the threaded tube 2.

When worn as earring or as a pendant, the wearer can conveniently add or remove items on either side of the wire 1 while the wire 1 is on the chain or through the earlobe.

Figure 2A:
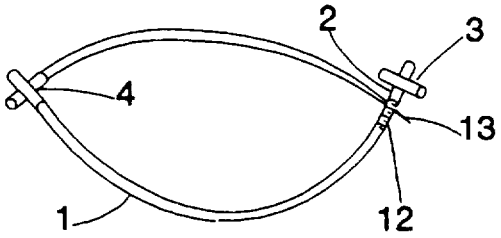
FIGS. 2*a* and 2*b* show a wire connection system in FIGS. 1*a* and 1*b* in various shapes for making a brooch or pin.
Figure 2B:
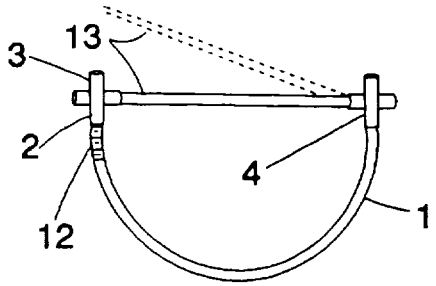
Figure 3:
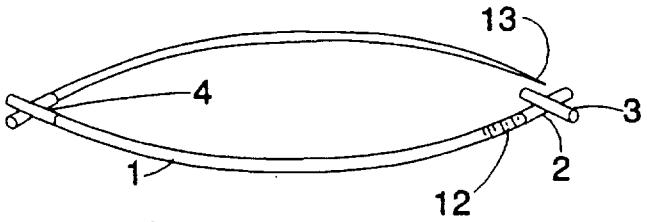
FIG. 3 shows a wire connection system wherein the connector tubes are not perpendicular.

The wire 1 in FIGS. 1*a* and 1*b* is bent into a shape that would be used for an earring, brooch or pendant. This standard shape could include a variety of bends, loops, twists and turns as decoration. The wearer could add or remove items while the wire connection system is being worn. FIGS. 2*a*, 2*b* and 3 show a wire connection system in FIGS. 1*a* and 1*b* in various shapes for making a brooch or tie pin. In FIGS. 2*a* and 2*b* the tubes 2 and 3 are perpendicular to one another. FIG. 3 shows a wire connection system wherein the connector tubes 2 and 3 are not perpendicular, however, the tubes are still oriented between 45° and 135° with respect to one another.

In FIGS. 2*a*, 2*b* and 3 the wire 1 includes an additional set of tubes that form an apex 4 to provide symmetry. A similar apex 4 is seen in the wire 1 shown in figure 1, however, the apex 4 is provided by a twist in the wire 1. The preferred embodiment for the wire 1 is a spring wire that can be both permanently bent to form shapes and also be moderately flexible to allow the wire 1 to be removed and inserted in the second tube 3 without permanently deforming the shape of the wire 1.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A wire connection system comprising:

a) a wire having a first end and a second end wherein said first end is threaded;

b) a first tube that is threaded wherein said threaded first end of said wire can be removably secured within said tube; and c) a second tube connected to said first tube such that said tubes are oriented between 45° and 135° with respect to one another and said second end of said wire can be removably secured in said second tube thereby securing said first tube by preventing rotation of said first tube.

2. The wire connection system of claim 1 wherein said tubes are perpendicular to one another.

3. A method of removably fastening a wire connection system, comprising the steps of:

a) providing a wire having a first end and a second end wherein said first end is threaded;

b) securing said threaded first end of said wire into a threaded tube that is connected to a second tube such that said tubes are oriented between 45° and 135° with respect to one another; and c) securing said second end of said wire by positioning said second end of said wire within said second tube thereby securing said first tube by preventing rotation of said first tube.

4. The method of claim 3 wherein said tubes are perpendicular to one another.

5. A method of creating jewelry, comprising the steps of:

a) providing a wire having a first end and a second end wherein said first end is threaded;

b) placing ornaments on said wire near said first end onto said wire from said first end;

c) securing said threaded first end of said wire into a threaded tube that is connected to a second tube such that said tubes are oriented between 45° and 135° with respect to one another;

d) placing ornaments on said wire near said second end onto said wire from said second end; and e) securing said second end of said wire by positioning said second end of said wire within said second tube thereby securing said first tube by preventing rotation of said first tube.

6. The method of claim 5 wherein said tubes are perpendicular to one another.

* * * * *